US005560387A

United States Patent [19]

Devier et al.

[11] Patent Number: 5,560,387

[45] Date of Patent: Oct. 1, 1996

[54] HYDRAULIC FLOW PRIORITY SYSTEM

[75] Inventors: Lonnie J. Devier; John J. Krone, both of Dunlap; Stephen V. Lunzman, Chillicothe, all of Ill.

[73] Assignee: Caterpillar Inc., Peoria, Ill.

[21] Appl. No.: 351,965

[22] Filed: Dec. 8, 1994

[51] Int. Cl.[6] ..... F15B 13/06

[52] U.S. Cl. ..... 137/1; 91/513; 91/517; 137/596.17

[58] Field of Search ..... 91/513, 517; 137/596.17, 137/1

[56] References Cited

U.S. PATENT DOCUMENTS 4,768,339 9/1988 Aoyagi et al. ..... 60/427

5,012,722 5/1991 McCormick ..... 137/625.65 X

*Primary Examiner*—Gerald A. Michalsky

*Attorney, Agent, or Firm*—Steven R. Janda; Thomas J. Bluth; James R. Yee

[57] ABSTRACT

A control system is provided for a hydraulic circuit having first and second hydraulic valves, a valve spool position sensor, and first and second input devices for producing first and second operation signals. A controller receives a signal from the valve spool position sensor and the second operation signal and responsively modifies the value of the second operation signal in response to the valve spool position signal.

13 Claims, 5 Drawing Sheets

HYDRAULIC FLOW PRIORITY SYSTEM

TECHNICAL FIELD

The present invention relates generally to fluid systems and more particularly to a hydraulic priority system for a construction machine or the like.

BACKGROUND ART

Hydraulic systems are utilized in many forms of construction equipment such as hydraulic excavators, backhoe loaders, and end loaders. The equipment is usually mobile having either wheels or track and includes a number of hydraulically actuated devices such as hydraulic cylinders and motors. In most cases the hydraulic circuits are controlled by a parallel valve arrangement in which a hydraulic pump provides pressurized fluids to a plurality of hydraulic valves each associated with a hydraulic cylinder or motor. As an operator manipulates control levers located in the operator's compartment, hydraulic valves are controllably opened and closed such that pressurized fluid is controllably directed to the desired cylinder or motor.

If two such hydraulic valves connected in a parallel arrangement are opened simultaneously, the amount of fluid flowing through each of the valves is dependent upon the relative pressures in each fluid circuit and the relative size of the openings of each valve. In many situations, however, it is desirable to give priority to one particular cylinder or motor that would ordinarily not receive a high flow rate when operated simultaneously with other low pressure circuits.

For example, if the control valve for the swing motor on an excavator is being operated at the same time that the stick cylinder is operated, it is advantageous to give priority to the swing motor. This is because the operator is most likely working on the sidewall of a trench and therefore requires a high force to be applied to the sidewall. To achieve the desired effect, it would be desirable if the hydraulic system would automatically give hydraulic flow priority to the swing motor by decreasing the flow directed to the stick cylinder. Similarly, if both the travel motor and the boom are being operated, it is advantageous to give priority to the travel motor.

The present invention is directed at overcoming one or more of the problems as set forth above.

DISCLOSURE OF THE INVENTION

In one aspect of the present invention there is provided a control system for a hydraulic circuit having first and second hydraulic valves, a valve spool position sensor, and first and second input devices for producing first and second operation signals. A controller receives a signal from the valve spool position sensor and one of the operation signals and responsively modifies the value of the received operation signal in response to the valve spool position sensor signal.

In a second aspect of the invention, a method is provided for controlling a hydraulic circuit having first and second hydraulic valves, and includes the steps of producing a valve spool position signal, producing first and second operation signals for operating the first and second hydraulic valves, respectively, and receiving the valve spool position signal and one of the operation signals and responsively modifying the value of the received operation signal in response to the valve spool position signal.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
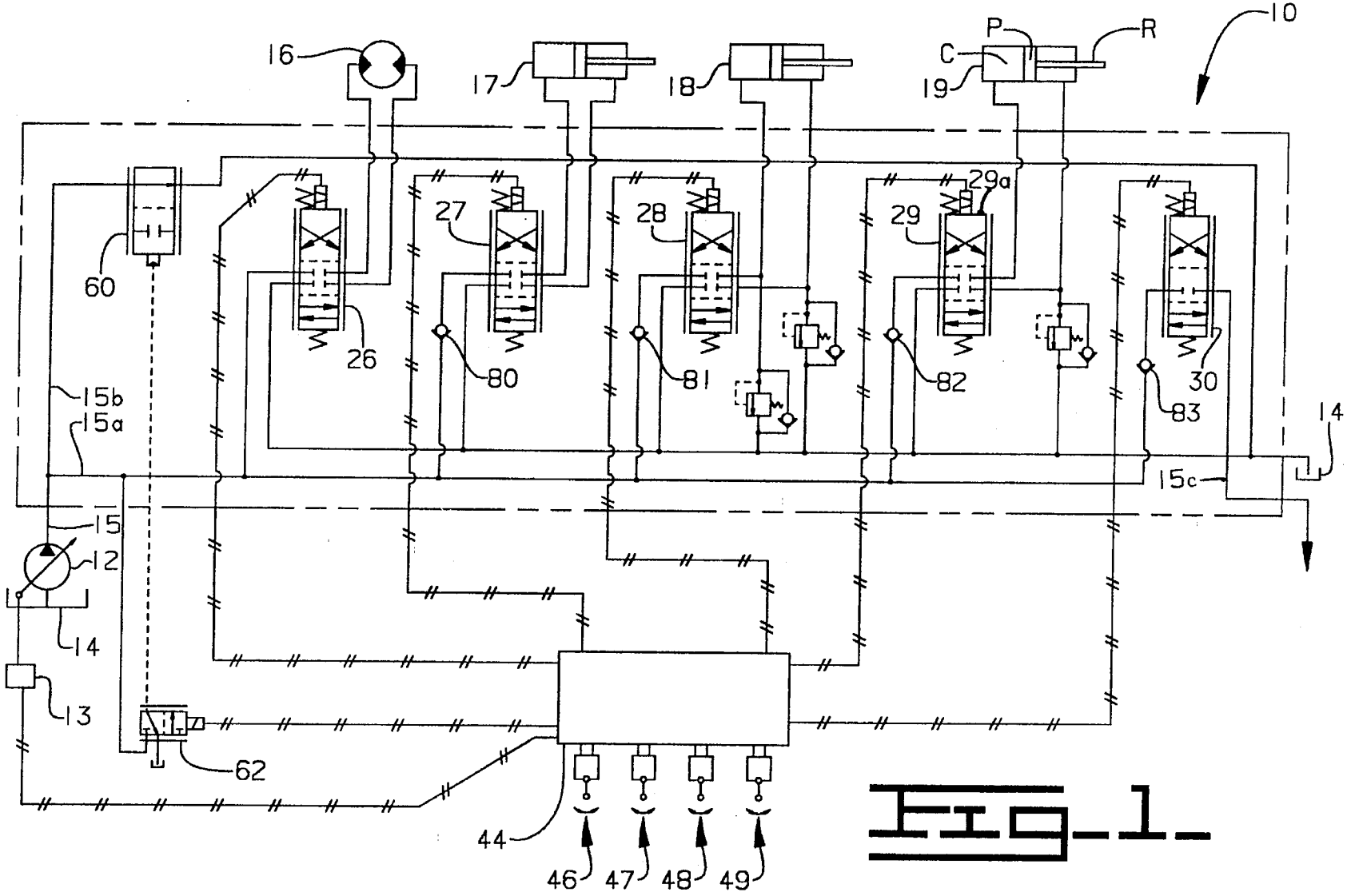
FIG. 1 is a schematic of a hydraulic system illustrating one preferred embodiment.

As shown in FIG. 1, a hydraulic system 10 includes a variable displacement hydraulic pump 12 for delivering fluid under pressure from a fluid reservoir 14 to a supply line 15, and four hydraulic actuators 16–19. Four variable or infinite positioning directional control valves 26–29 are connected to supply line 15 via branch line **15*a* and are operative to control flow of the hydraulic fluid to each of the actuators 16–19, respectively. A fifth control valve 30 operates as a crossover valve for a purpose described below. Each of the control valves 26–30 is of the closed-center type and is preferably solenoid operated in response to electrical signals produced by a controller 44 including a microprocessor. In the preferred embodiment, the control valves 26–30 are actuated by devices known in the art as voice coil type actuators. It should be appreciated by those skilled in the art, however, that virtually any electrohydraulic actuator will work including proportional pilot pressure valves. Manually operated control devices 46–49, which may be potentiometers, pulse width modulated devices, or other suitable control inputs, generate control signals that are input to the controller 44 to operate the control valves 26–30, respectively. The control devices 46–49 may be electronic joysticks and/or peddles. Control devices 46–49 are conveniently hard wired to the controller 44** which includes a plurality of control algorithms.

A bypass line **15*b* is provided to return fluid to the reservoir 14. An infinite positioning bypass valve 60 is interposed in the bypass line 15*b* and is operated by an infinite positioning pilot valve 62 under control of the controller 44**.

In operation, when the system 10 is idling (i.e. there is little or no usage by the hydraulic actuators 16–19), bypass valve 60 is wide open to provide flow through bypass line **15*b*. When one or more control valves 26–30 are opened, bypass valve 60 closes simultaneously, increasing pressure in the line 15*b*. The increased pressure allows pump flow to open load checks 80–83 and provide flow to control valves 26–30. The bypass valve 60 is modulated under control of controller 44 to provide operation of the closed-center valves 26–30 as if the system were one having open-center valves. Advantageously, flow from the pump 12 increases in response to control signals from the input levers 46–49 being produced. In response to the control signals, the controller 44 delivers a signal to the pump actuator 13** causing the proper pump output to be produced for the desired system operation, as indicated by the control signals.

The controller 44 sends a suitable output signal to pilot valve 62 for controlling (i.e. modulating) the position of the spool of the bypass valve 60. Likewise, output signals are sent to solenoids included in the control valves controlling the spool positions. An output signal also controls the crossover valve 30. Further, the controller 44 provides a signal to the pump control 13 for controlling the variable displacement pump 12.

Figure 2:
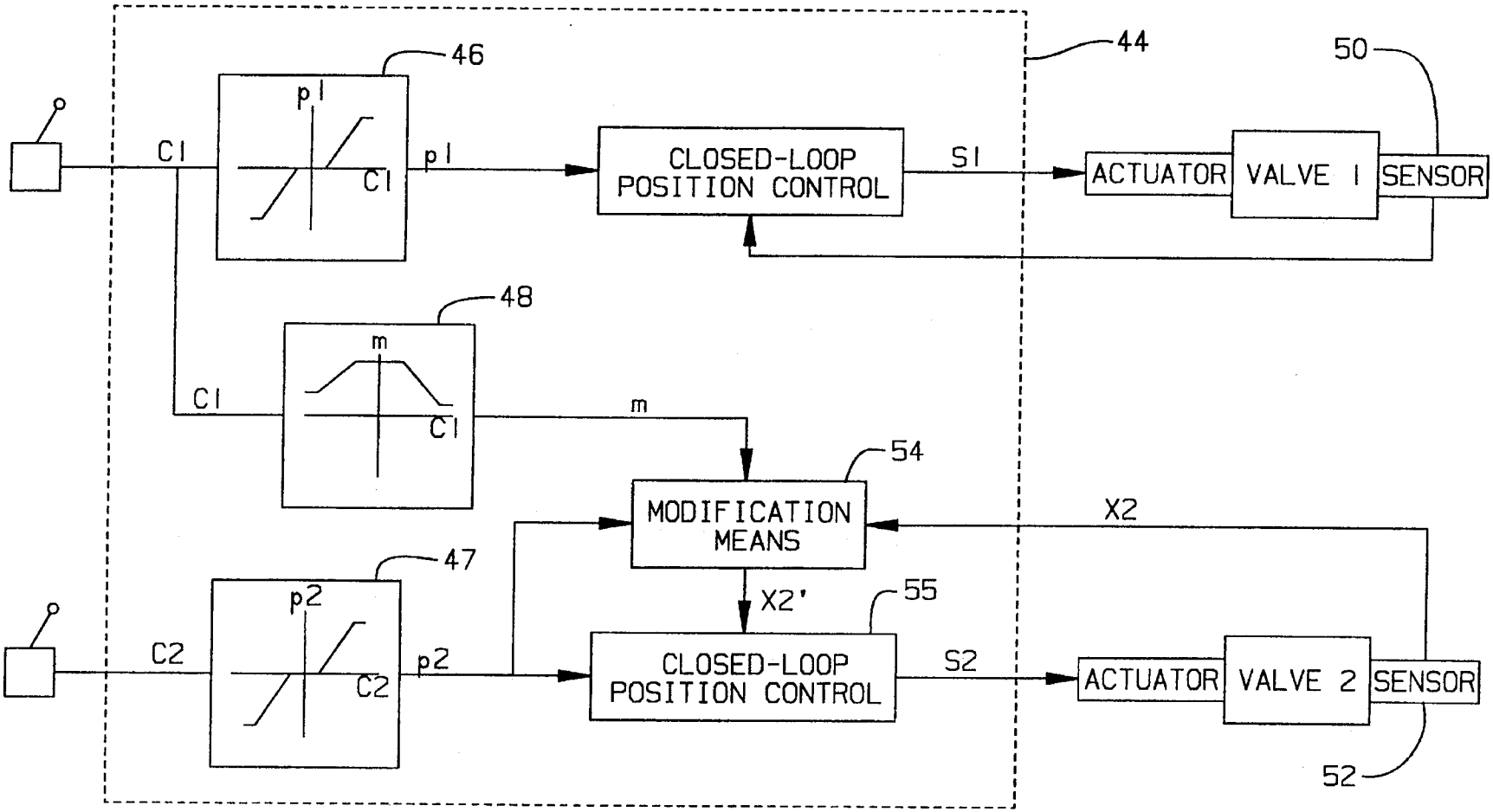
FIG. 2 is a diagrammatic illustration of a control used in an embodiment of the present invention.

Turning now to FIG. 2, a control arrangement is shown for providing valve priority in a hydraulic circuit with a parallel valve arrangement. In the embodiment shown, only two inputs from the control devices 46–49 are illustrated for simplicity. However, it should be understood that in the preferred embodiment, the other two control signals are also delivered to the controller 44. It should also be appreciated that virtually any combination of input signals can be used to provide different priority arrangements without deviating from the invention. The particular hydraulic circuits associated with valve 1 and valve 2, e.g. the swing and stick circuits of a hydraulic excavator, are selected in response to the desired functional characteristics of the machine.

The controller 44 accepts control signal inputs C1, C2 from two of the control devices 46–49 and delivers actuator signals S1, S2 to the control valves 26–30. Advantageously, each of the control signals C1, C2 are delivered to a stroke control map 46 and a priority control map 48. The stroke control and priority control maps 46, 48 are preferably look-up tables of a type well-known in the art. In the preferred embodiment, a dead-band exists in the stroke control maps and priority control map such that no signal is output from the map if the operator's lever is moved only a slight degree. In the preferred embodiment, the magnitude of the map output is increased as the control device is deflected further in either direction until a maximum or minimum is reached.

The stroke control maps 46, 47 preferably produce positive signals when the control device moves in a direction arbitrarily chosen as the positive direction, and a negative signal when moved in the opposite direction. The priority control map 48, on the other hand, produces positive signals in response to movement of the control device in either direction. Alternatively, the priority control map 48 may be designed to not produce any signal in response to the control device being moved in the negative direction. The latter arrangement would be appropriate if the vehicle designer does not wish to have the priority function active when the circuit associated with valve 1 is operated in such a way that significant hydraulic power is not required by that circuit. For example, a vehicle designer may want the priority function to be active when the boom is being raised, but not when it is being lowered. The output, m, of the priority control map 48 serves to limit the stroke for valve 2, as described below. In the preferred embodiment the value for "m" is selected in response to the control signal C1 being delivered to a look-up table.

The controller 44 includes electronic closed-loop position controls that compare the desired valve spool positions to the sensed actual valve spool positions in order to generate the actuator signals. To accomplish this closed-loop position control, position sensors 50, 52 are connected to the spool of valve 1 and valve 2. In the preferred embodiment, the position sensors 50, 52 are linear variable displacement transducer (LVDT) type position sensors. It should also be noted, however, that any type of spool displacement sensor providing acceptable accuracy could be used.

The controller 44 modifies the sensed valve spool position for valve 2 in order to provide valve 1 with higher priority to the pump flow than valve 2. This valve priority control thus causes the stroke of valve 2 to be reduced when the stroke of valve 1 is increased and effectively provides valve 1 with flow priority. The modification means 54 employs any suitable mathematical method that will increase the value of the sensed valve spool position X2 such that the closed-loop control will decrease the control signal S2 as C1 is increased to decrease the position of the valve spool and reduce the flow demanded by valve 2.

Figure 3:
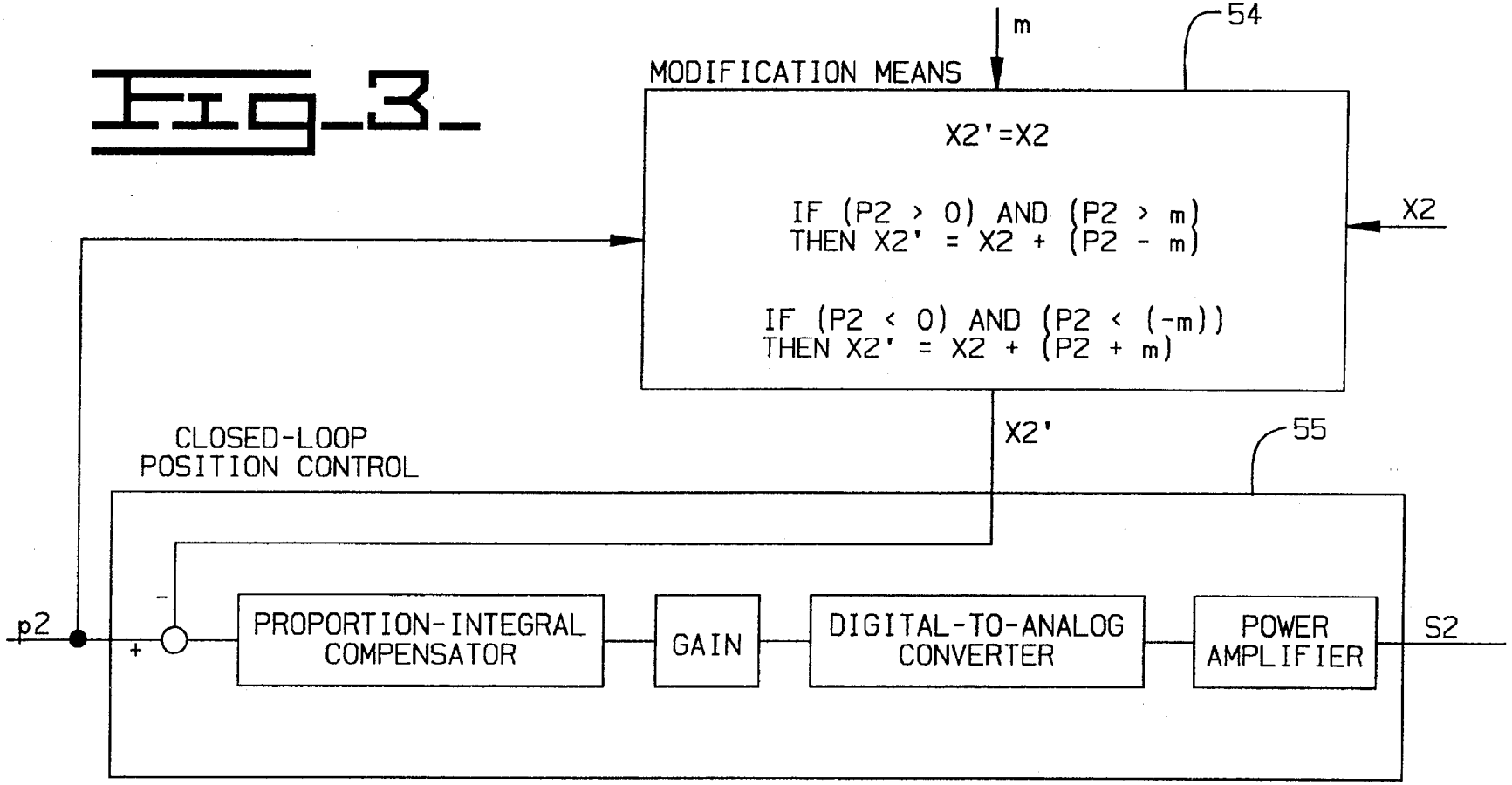
FIG. 3 is a diagrammatic illustration of a portion of the control shown in FIG. 2.

An embodiment of the modification means 54 and closed-loop position control 55 is illustrated in FIG. 3. As illustrated in connection with block 54, the modified position signal X2' is set equal to x2. However, if the control signal p2 is greater than zero and also greater than the output from the priority control map 48, then the modified position signal X2' is set equal to the position signal, x2, plus the control signal, p2, minus the output from the priority control map 48. Alternatively, if the control signal p2 is less than zero and also less than the negative of the output from the priority control map 48, then the modified position signal X2' is set equal to the position signal, x2, plus the control signal, p2, plus the output from the priority control map 48.

The preferred closed-loop control is illustrated and includes a proportion-integral compensator to modify the dynamics of the control. In a manner well-known in the art, the gains and functions included for the proportion-integral compensator are derived by developing a mathematical model of the system and verifying the system response through test. The output of the proportion-integral compensator is multiplied by a gain constant and then converted to an analog signal before it is amplified and delivered to the solenoid actuator for operation of valve 2.

Figure 4:
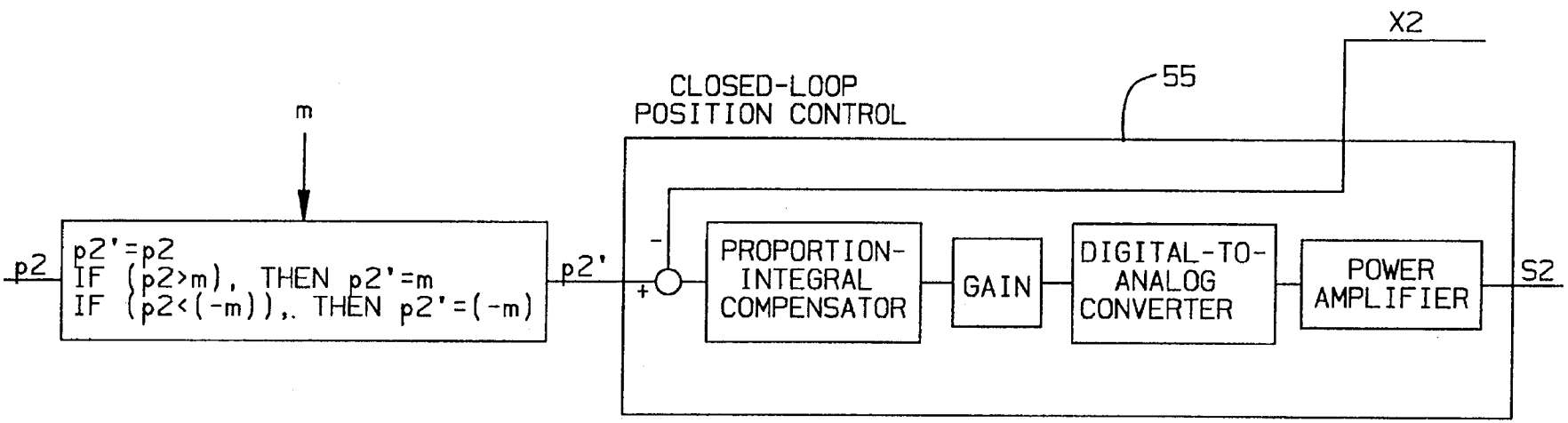
FIG. 4 is a diagrammatic illustration of a control used in a second embodiment of the present invention.

An alternative embodiment for the modification means 54 and closed-loop position control 55 is illustrated in FIG. 4. In this embodiment, the output, m, of the priority control map 48, serves as a limit to the value of the control signal p2. The modified control signal p2' is then used as the input for the closed-loop position control 55 and the unmodified position signal x2 is used for feedback.

Figure 5:
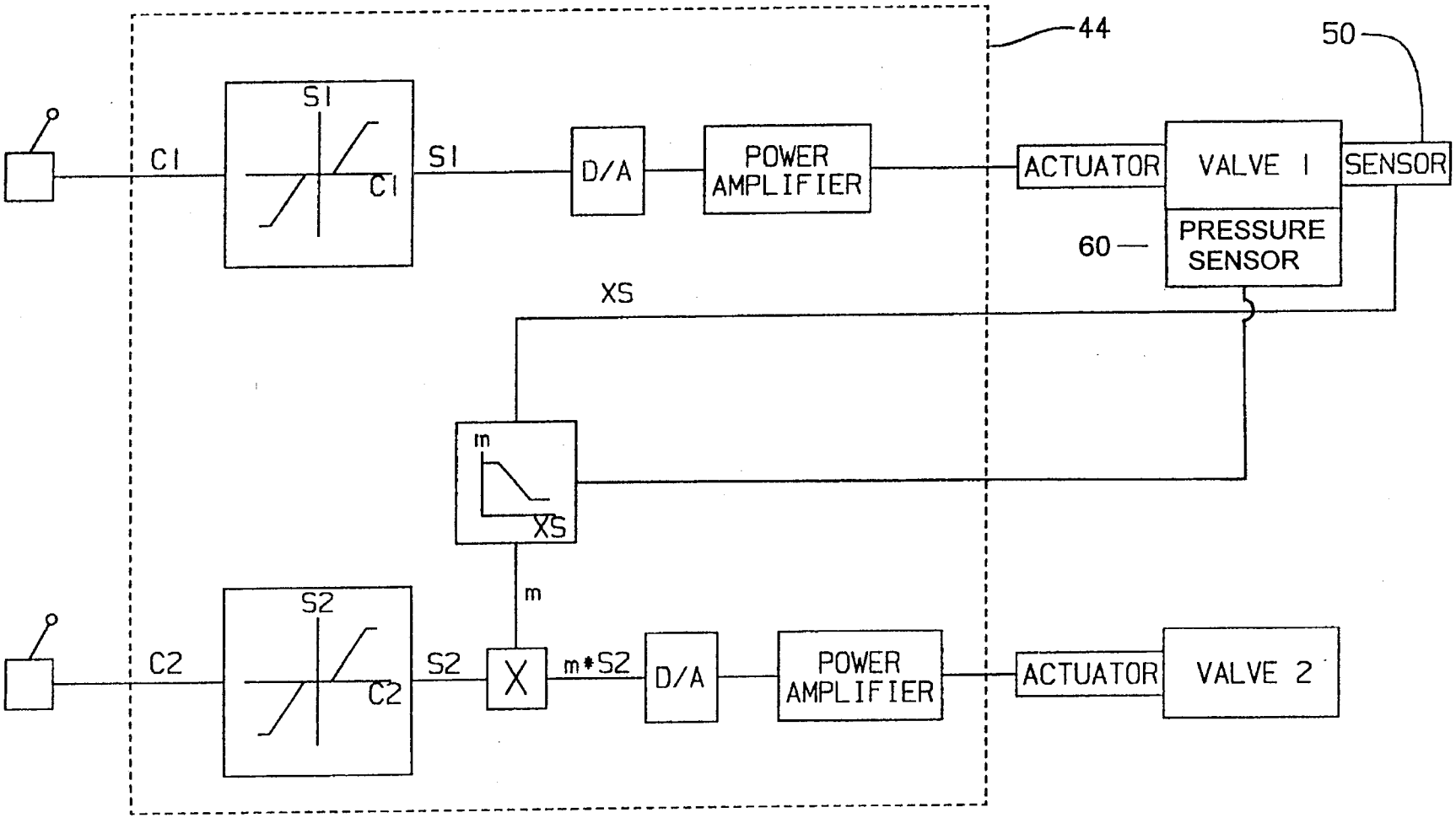
FIG. 5 is a diagrammatic illustration of a control used in another embodiment of the present invention.

Turning now to FIG. 5, another alternative embodiment of the electronic control is shown for providing valve priority in a hydraulic circuit with a parallel valve arrangement. The controller 44 accepts inputs from the operator's levers and delivers control signals to control the position of the main valve spools. The hydraulic valves are part of a parallel hydraulic circuit in which all valves have equal access, or priority, to flow available from the main pump. The controller modifies the actuator signals in order to provide valve 1 with higher priority to the pump flow. A position sensor 50, preferably a LVDT, connected to the spool on valve 1 determines actual valve spool position XS which is sent to the controller 44 and is used to determine a multiplier constant "m" which in turn is used to reduce the flow demanded by valve 2. In the preferred embodiment the value for "m" is selected in response to the position signal XS being delivered to a look-up table. The value of "m" preferably ranges from 1 to a minimum value greater than, but relatively near, zero. The actual minimum value of "m" is selected as a matter of design choice and may be equal to zero.

In yet another alternative embodiment, a pressure sensor 60 may be placed in the hydraulic circuit associated with valve 1 such that the value of "m" is selected in response to not only the position signal XS but also the pressure signal. This arrangement thus compensates for the effect of pressure on sensed valve position. In practice, a pressure correction is obtained from a look-up table in response to the hydraulic circuit pressure. Then, either the position signal XS is delivered to a look-up table or a multiplier for correcting position in response to the pressure correction. Alternatively, the value of "m" is delivered to a look-up table or multiplier for correcting "m" in response to the pressure correction.

Advantageously, the value of "m" remains at 1 when the position signal XS is zero or relatively near zero. As the position signal XS increases, the value of "m" progressively decreases to some minimum value. The value of "m" is then multiplied by the signal S2 from the stroke control map associated with valve 2. The product is delivered to a digital to analog converter and is amplified before being delivered to the solenoid actuator connected to valve 2. This control reduces the stroke of valve 2 when the stroke of valve 1 is increased and thus effectively provides valve 1 with flow priority. It should be understood that the signal from the spool displacement sensor may also be used to correct error between what is commanded for that spool and what is actually measured by way of a closed loop control.

Industrial Applicability

The hydraulic system 10 is advantageously used in construction equipment such as hydraulic excavators, backhoe loaders and end loaders. The hydraulic actuator 17 may operate an attachment device and the hydraulic lines leading to it conveniently have quick disconnects. Hydraulic actuators 18 and 19 may be a bucket cylinder and a boom cylinder, respectively, in the form of hydraulic rams. As diagrammatically illustrated in FIG. 1, the hydraulic rams each include a piston P mounted in a cylinder C for reciprocation therein, and at least one piston rod R connected to the piston P and extending out of the cylinder C. The hydraulic lines leading to bucket cylinder 18 typically have relief valves in parallel with a one-way or check valve that serves as a make-up valve to limit cavitation. Similarly, a hydraulic line from the boom cylinder 19 has a relief valve and a one-way valve. The uppermost position 29*a* (as shown in FIG. 1) of control valve 29 advantageously has restrictors and a check valve which serve to feed fluid to the opposite end of the boom cylinder 19 as it is lowered, for flow regeneration and energy conservation. The check valve could be a separate valve, if desired.

A second, similar hydraulic system, complete with pump and directional control valves may be under control of controller 44 and supply fluid to the second travel motor, a swing motor and a stick cylinder. For this purpose, control valve 30 serves as a crossover valve directing pump flow via line 15*c* to another valve (not shown) which may be a control valve for the stick cylinder. This allows combining pump flows for operations which may utilize higher flows.

In operation, the present invention provides flow priority to a hydraulic valve that is operated simultaneously with a second hydraulic valve. The controller 44 reduces the stroke of the second valve when the stroke of the first valve is increased thus providing the first valve with flow priority. Control of priority based on actual spool position provides the ability to compensate for changes in spool position caused by flow forces and the like. The control may be applied to multiple valves that control hydraulic cylinders or motors.

Other aspects, features and advantages can be understood from a study of this disclosure together with the appended claims.

We claim:

1. A control system for a hydraulic circuit having at least first and second hydraulic valves including first and second spools, respectively, comprising:

a valve spool position sensor connected to one of the first and second spools and being adapted to produce a valve spool position sensor signal;

first and second actuator means for producing first and second operation signals for operating the first and second hydraulic valves, respectively; and priority means for receiving a signal from said valve spool position sensor and one of said first and second operation signals and for responsively modifying the value of the received operation signal in response to said valve spool position sensor signal.

2. A control system, as set forth in claim 1, wherein said valve spool position sensor is connected to said first spool.

3. A control system, as set forth in claim 2, wherein the second hydraulic valve operates in response to the modified operation signal.

4. A control system, as set forth in claim 3, wherein said priority means reduces the value of said second operation signal as said valve spool position sensor signal increases.

5. A control system, as set forth in claim 2, wherein said valve spool position sensor is a

6. A control system, as set forth in claim 1, wherein said valve spool position sensor is connected to the second spool.

7. A control system, as set forth in claim 6, wherein said priority means includes a closed loop control and means for modifying the response of said closed loop control in response to said first operation signal.

8. A control system, as set forth in claim 6, wherein said priority means includes a closed loop control and a means for limiting said second operation signal in response to said first operation signal.

9. A control system, as set forth in claim 1, wherein said priority means receives a signal from said valve spool position sensor and said first and second operation signals and responsively modifies the value of said second operation signal in response to said valve spool position sensor signal and said first operation signal.

10. A method for controlling a hydraulic circuit having first and second hydraulic valves having first and second spools, respectively, comprising the steps of:

producing a valve spool position signal indicative of the position of the first spool;

producing first and second operation signals for operating the first and second hydraulic valves, respectively;

receiving the valve spool position signal and one of the operation signals and responsively modifying the value of the received operation signal in response to the valve spool position signal; and operating the second hydraulic valve in response to the modified operation signal.

11. A method as set forth in claim 10 including the step of compensating the valve spool position signal in response to a pressure signal indicative of pressure in the hydraulic circuit associated with the first hydraulic valve.

12. A method, as set forth in claim 10, wherein said step of modifying the value of the received operation signal includes the step of reducing the value of the received operation signal as the valve spool position sensor signal increases.

13. A method, as set forth in claim 10, wherein said step of modifying the value of the received operation signal includes the steps of receiving the valve spool position signal and the first and second operation signals and responsively modifying the value of the second operation signal in response to the valve spool position signal and the first operation signal.

* * * * *